United States Patent [19]

Granados

[11] 4,103,378

[45] Aug. 1, 1978

[54] PORTABLE-THREE-IN-ONE BICYCLE TOOL

[76] Inventor: Javier F. Granados, 204 E. 1st Pl., Kennewick, Wash. 99336

[21] Appl. No.: 822,930

[22] Filed: Aug. 8, 1977

[51] Int. Cl.[2] ..... B25F 1/00

[52] U.S. Cl. ..... 7/138; 7/167; 29/407

[58] Field of Search ..... 7/1 R, 1 G; 29/159.1, 29/159.2, 407

[56] References Cited

U.S. PATENT DOCUMENTS

| | | | |
|---|---|---|---|
| 2,471,593 | 5/1949 | Toye | 7/1 G |
| 3,742,533 | 7/1973 | Brunette | 7/1 G |

*Primary Examiner*—James L. Jones, Jr.
*Assistant Examiner*—James G. Smith

[57] ABSTRACT

This tool consists primarily of a main body, which will be bolted to a bicycle when in use. It includes a threaded and removable handle, for spreading and loosening a tight chain link, and the handle has provision means, for use on wheel spokes, and is a chain rivet extractor as well. The main body of this tool includes storage means for a pair of extra rivet extractor tips, and has centering guides which are used when extracting or resetting chain rivets, and one end of the main body has a tapered cut-out, which will accept all tubular rims and clincher rims, sizes up to $1\frac{3}{8}$ inch wide, that need to be aligned and trued.

5 Claims, 7 Drawing Figures

FIG. 2
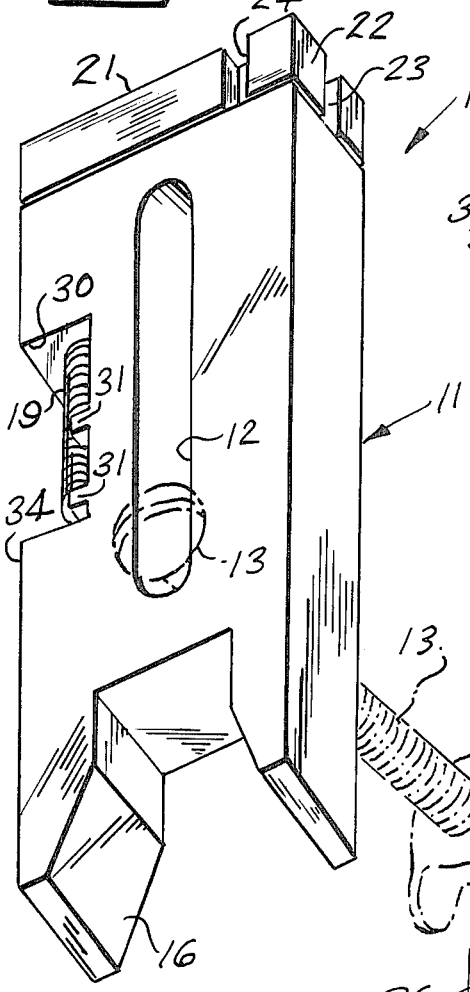
FIG. 3
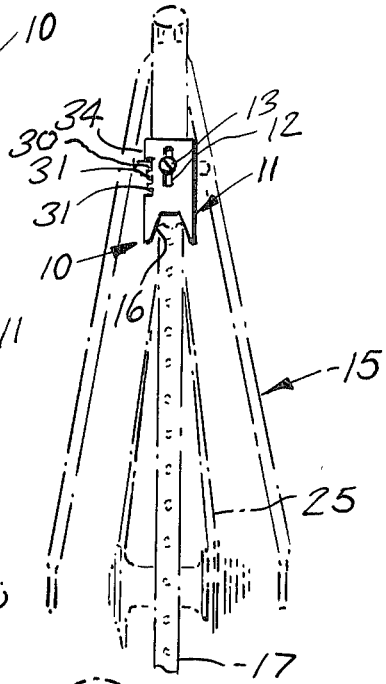
FIG. 4
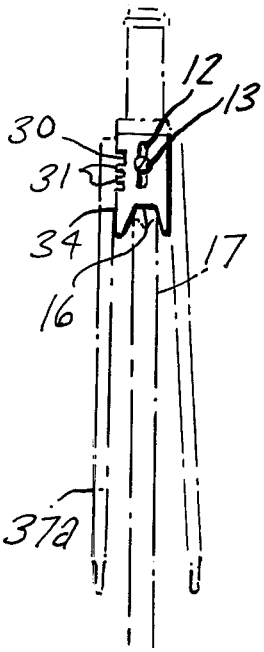
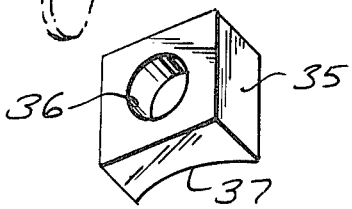
FIG. 5
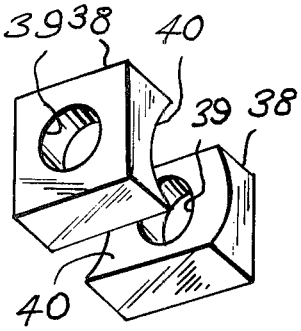
FIG. 6
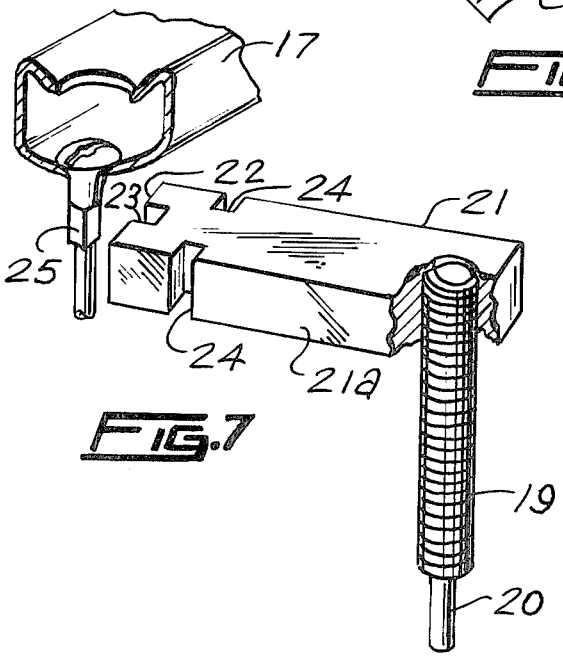
FIG. 7

PORTABLE-THREE-IN-ONE BICYCLE TOOL

This invention relates to hand tools, and more particularly, to a portable three-in-one bicycle tool.

It is, therefore, the principal object of this invention to provide a portable three-in-one bicycle tool, which will enable the user to true and dish bicycle wheels.

Another object of this invention is to provide a portable three-in-one bicycle tool, which will have a removable handle portion that includes a chain rivet extractor, which will also be used for re-setting chain rivets.

A further object of this invention is to provide a tool of the type described, which will have one end of the handle portion of such structure, so as to be used as three sizes of spoke wrenches on the spokes of a bicycle wheel.

Other objects of the invention are to provide a portable three-in-one bicycle tool which is simple in design, inexpensive to manufacture, rugged in construction, easy to use and efficient in operation.

These and other objects will be readily evident, upon a study of the following specification, and the accompanying drawings, wherein:

FIG. 2 is an assembled perspective view of the invention, showing the mounting bolt and nut fastener for securing the tool to a bicycle;

FIG. 3 is a phantom and fragmentary end view of a rear wheel of a bicycle, showing the tool being used to true the wheel, in two directions;

FIG. 4 is similar to FIG. 3, but shows the tool being used to true the front wheel, in two directions;

FIGS. 5 and 6 are perspective views of spacers for use with the tool; and FIG. 7 is a fragmentary perspective view of the handle of the tool, which is used to loosen or tighten the spokes of the bicycle wheels.

Figure 1:
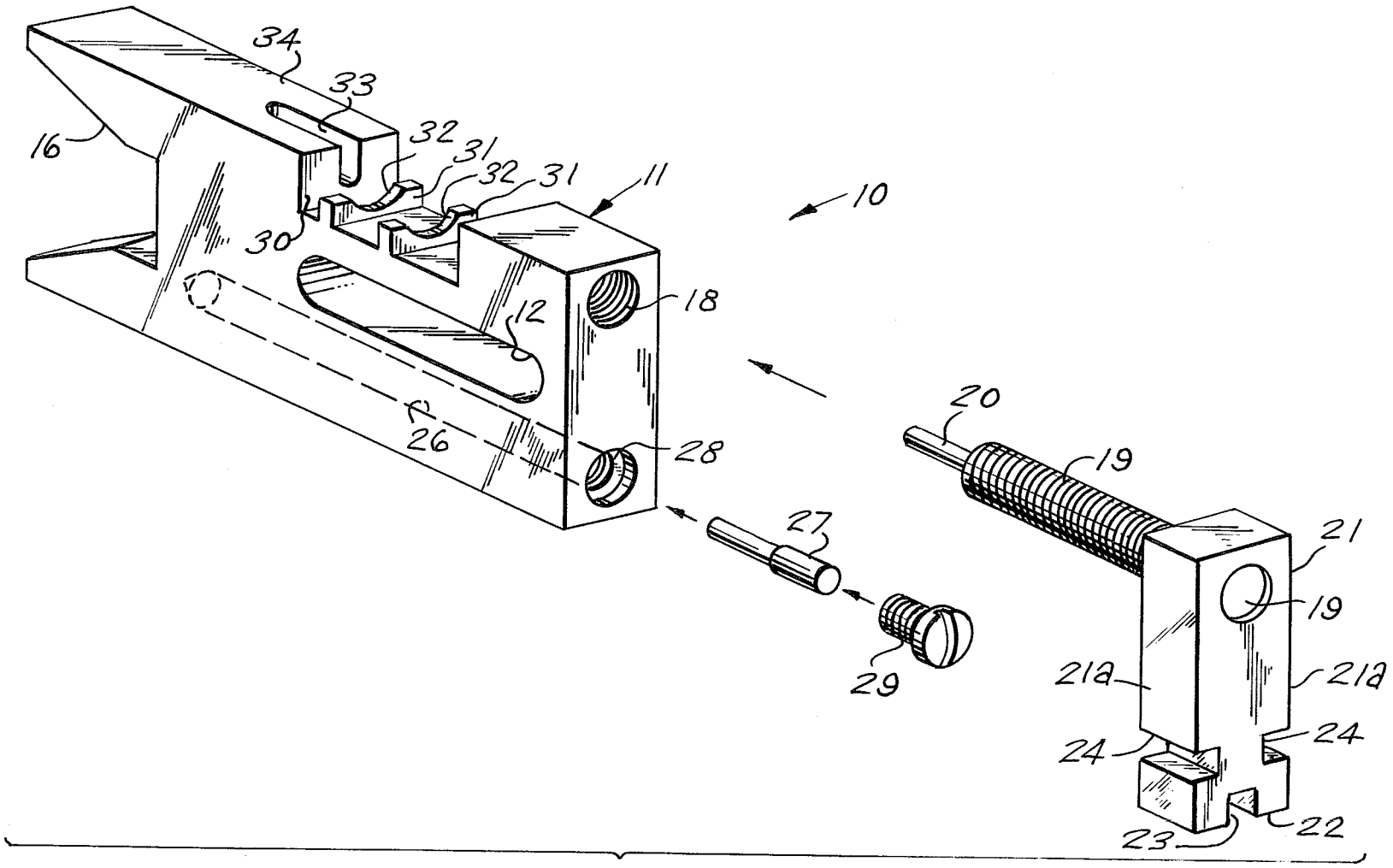
FIG. 1 is an exploded perspective view of the present invention.

According to this invention, tool 10, is shown to include a main body 11 of enlongated configuration, having an enlongated slot 12 therethrough, for adjustably receiving a threaded bolt 13, that receives a winged nut fastener 14. Bolt 13 and nut fastener 14 are used to secure tool 10 to bicycle 15. A tapered cut-out 16, on one end of main body 11, provides a means of accepting all tubular rims 17 and clincher rims. A threaded opening 18, on the opposite end of main body 11, removably receives threaded shaft 19, having an extending shank 20. Shaft 19 is fixedly secured to handle 21. On the opposite end of handle 21 is a rectangular slot 23, and, on the sides 21*a*, are similar slots 24, for receiving spokes 25 of a typical rim 17, as is shown in FIG. 7 of the drawings. The various slots 23 and 24 are of different sizes, to accommodate various spoke 25 sizes.

An enlongated opening 26, in main body 11, serves as a means for storing a pair of rivet extractor tips 27, (one of which is shown). The threaded portion 28, of opening 26, removably receives screw-plug 29, which prevents tips 27 from coming out of opening 26, when stored.

Slot 30, in main body 11, has, extending from the bottom therein, a pair of spaced apart guide portions 31 which are integral of main body 11, and are recessed at 32, so as to serve as centering guide means, when shaft 19 of handle 21 is used to extract, or reset, chain rivets. A slot 33, through surface 34, intersects with slot 30, so as to freely receive extending shank 20, of shaft 19. Spacer 35, having an opening 36 and concave surface 37, is used on the fork 37*a*, and spacer clamps 38, having openings 39 and concave surfaces 40, are used when tool 10 is mounted on the rear brake stay.

In use, main body 11, may be mounted on either the front fork 37*a*, after removing the front brake, or may be mounted on the rear brake stay, after the rear brake has been removed, depending upon which wheel rim 17 is to be aligned and trued at the same time.

When main body 11 is mounted on the rear brake stay, it will enable the user to automatically center, or dish, the rear wheel simultaneously, as the user is truing the wheel rim 17. The machined slot 12, of main body 11, enables adjustment, to place the main body 11 in proper position with respect to the wheel rim 17, being aligned.

As the wheel rim 17 process progresses, the main body is moved closer to the rim 17, until the rim 17 has been trued in two directions, lateral straightness and concentricity.

The centering guide portions 31 are for the purpose of properly positioning the chain rivet, to extracted or installed, and the second guide portion 31 is used to loosen or tighten a chain link plate.

While various changes may be made in the detail construction it is understood that such changes will be within the spirit and scope of the present invention, as is defined by the appended claims.

What I now claim is:

1. A portable three-in-one bicycle tool, comprising an elongated main body of rectangular cross-sectional configuration, a cut-out portion in one end of said main body providing a means of trueing a wheel of a bicycle, a threaded bolt and wing nut fastener removably securing said main body to a bicycle, a handle with spoke adjustment means and a shaft means for adjusting and fixing a bicycle chain, received removably in said main body, and a chamber within said main body for storing rivet extractor tips.

2. The combination according to claim 1, wherein said cut-out portion of one end of said main body is tapered, so as to removably receive a bicycle wheel rim, said cut-out engaging said wheel rim as it is rotated, so as to true the wheel rim, laterally and concentrically, as said main body is adjustably lowered by means of said threaded bolt, which is freely received in an elongated slot that is aligned along the longitudinal axis of said main body of said tool, and said shaft means of said handle is threadably and removably received in the end opposite of said end having said tapered slot.

3. The combination according to claim 2, wherein said shaft is provided with an extending shank for extracting rivets of the bicycle chain, and said shank is freely received within a slot intersecting a slot having guide portions for said shaft received therein, and said guide portions are a pair, which are spaced apart and integral of said main body for centering said shaft.

4. The combination according to claim 3, wherein said shaft is fixedly secured in one end of said handle, said handle being received flush with one end of said main body when not in use, and the opposite end of said handle is provided with a plurality of spaced apart slot openings for receiving wheel spokes that are to be tightened or loosened.

5. The combination according to claim 4, wherein said chamber within said main body removably receives said extractor tips and said opening threadingly receives a screw-plug which serves as retaining means for said extractor tips, within said chamber of said main body.

* * * * *